US011826920B1

(12) United States Patent
Mandeville

(10) Patent No.: US 11,826,920 B1
(45) Date of Patent: Nov. 28, 2023

(54) POCKET KNIFE

(71) Applicant: A. Mark Mandeville, Mills River, NC (US)

(72) Inventor: A. Mark Mandeville, Mills River, NC (US)

(73) Assignee: Microtech Knives, Inc., Mills River, NC (US)

( * ) Notice: Subject to any disclaimer, the term of this patent is extended or adjusted under 35 U.S.C. 154(b) by 0 days.

(21) Appl. No.: 18/335,631

(22) Filed: Jun. 15, 2023

(51) Int. Cl.
*B26B 1/08* (2006.01)
*B26B 1/10* (2006.01)

(52) U.S. Cl.
CPC . *B26B 1/08* (2013.01); *B26B 1/10* (2013.01)

(58) Field of Classification Search
None
See application file for complete search history.

(56) References Cited

U.S. PATENT DOCUMENTS

| | | | | |
|---|---|---|---|---|
| 6,085,423 | A | 7/2000 | Marifone | |
| 7,305,769 | B2 | 12/2007 | McHenry | |
| 7,562,455 | B2 | 7/2009 | McHenry | |
| 7,574,804 | B2 | 8/2009 | Bezold | |
| 8,595,941 | B2 | 12/2013 | Lee | |
| 8,671,578 | B1 | 3/2014 | Frazer | |
| 9,375,854 | B2 | 6/2016 | Chu | |
| 9,498,889 | B1 | 11/2016 | Hawk | |
| 9,764,485 | B1 | 9/2017 | Hawk | |
| 10,220,527 | B1 | 3/2019 | Marfione | |
| 10,500,740 | B1 | 12/2019 | Marfione et al. | |
| 10,807,253 | B1 | 10/2020 | Mandeville | |
| 10,981,284 | B2 * | 4/2021 | Delplanche | B26B 1/10 |
| 11,607,818 | B1 | 3/2023 | Crawford et al. | |
| 2006/0207102 | A1 | 9/2006 | Bezold | |
| 2007/0175045 | A1 | 8/2007 | McHenry | |
| 2008/0222895 | A1 | 9/2008 | Marfione | |
| 2008/0222897 | A1 | 9/2008 | Marfione | |
| 2009/0235534 | A1 | 9/2009 | Chu | |
| 2014/0101943 | A1 | 4/2014 | Chu | |
| 2014/0173911 | A1 | 6/2014 | Chu | |
| 2021/0023725 | A1 * | 1/2021 | Buerk | B26B 5/00 |
| 2021/0268671 | A1 * | 9/2021 | Buerk | B26B 1/08 |
| 2021/0276204 | A1 * | 9/2021 | Marfione | B26B 1/10 |

FOREIGN PATENT DOCUMENTS

| | | |
|---|---|---|
| CA | 2 742 523 | * 12/2012 |

* cited by examiner

*Primary Examiner* — Hwei-Siu C Payer
(74) *Attorney, Agent, or Firm* — Steve LeBlanc, LLC

(57) ABSTRACT

A pocket knife includes a chassis that defines a cavity. A blade having a cutting edge has a retracted position in which the cutting edge is inside the cavity and a deployed position in which the cutting edge is outside of the cavity. A front operator inside the cavity engages with the blade to move the blade to the retracted position, and a rear operator inside the cavity engages with the blade to move the blade to the deployed position. A spring connected between the front operator and the rear operator provides a tension between the front and rear operators. An adjustable connection between the spring and the rear operator has a plurality of positions to adjust the tension between the front and rear operators.

20 Claims, 8 Drawing Sheets

POCKET KNIFE

FIELD OF THE INVENTION

The present invention generally involves a pocket knife. In particular embodiments, the pocket knife may be a double action, out-the-front configuration.

BACKGROUND OF THE INVENTION

Pocket knives provide a convenient tool for cutting that may be easily carried by a user for deployment when desired. For some pocket knife designs, two hands are needed to deploy and retract a blade, while other designs include a spring that assists a user to deploy and/or retract the blade using a single hand. Each design balances the convenience and speed of operation with increased risk associated with inadvertent operation.

A switchblade is a particular style of pocket knife that has a folding or sliding blade that automatically deploys when an actuator is operated. A single action switchblade typically includes a spring under tension with the blade when the blade is retracted, and operation of the actuator releases the blade to allow the spring tension to automatically deploy the blade. Once deployed, the actuator is released to engage a lock that holds the blade in the deployed position. To retract a single action switchblade, the actuator is again operated to disengage the lock, and the blade must be manually retracted against the spring tension.

In contrast, a double action switchblade typically includes a slider, front and rear operators connected by a spring, and front and rear locks. To deploy a double action switchblade, the actuator may be moved forward to move the slider forward. Forward movement of the slider moves the front operator forward while the rear operator is engaged with the rear of the blade to charge the spring. Forward movement of the slider eventually releases the rear lock to allow the charged spring to deploy the blade, and the front lock engages with the deployed blade to hold the blade in the deployed position. To retract a double action switchblade, the actuator is moved rearward to move the slider rearward. Rearward movement of the slider moves the rear operator rearward while the front operator is engaged with the blade to charge the spring. Rearward movement of the slider eventually releases the front lock to allow the charged spring to retract the blade, and the rear lock engages with the retracted blade to hold the blade in the retracted position.

Although a double action switchblade often provides convenient one-handed operation, the amount of force needed to move the actuator to adequately charge the spring to deploy and retract the blade may be difficult for some users. In addition, manufacturing tolerances in the spring length and elasticity may vary the amount of force required to move the actuator and/or reliability of operation. For example, a spring with a shorter length or a higher modulus of elasticity increases the amount of force required to move the actuator, making operation of the switchblade more difficult. Conversely, a spring with a longer length or a lower modulus of elasticity decreases the amount of force required to move the actuator, making operation of the switchblade less difficult. However, the reduced force applied to the spring may not adequately charge the spring to reliably deploy and retract the blade. Therefore, the need exists for an improved switchblade that may adjust the tension in the spring to provide convenient and reliable one-handed operation.

BRIEF DESCRIPTION OF THE INVENTION

Aspects and advantages of the invention are set forth below in the following description, or may be obvious from the description, or may be learned through practice of the invention.

One embodiment of the present invention is a pocket knife that includes a chassis that defines a cavity. A blade having a cutting edge has a retracted position in which the cutting edge is inside the cavity and a deployed position in which the cutting edge is outside of the cavity. A slider inside the cavity has a rear position that moves the blade to the retracted position and a front position that moves the blade to the deployed position. A front operator is inside the cavity, and the slider engages with the front operator to move the blade to the deployed position. A rear operator is inside the cavity, and the slider engages with the rear operator to move the blade to the retracted position. A spring connected between the front operator and the rear operator provides a tension between the front and rear operators. The pocket knife further includes a means for adjusting the tension between the front and rear operators.

An alternate embodiment of the present invention is a pocket knife that includes a chassis that defines a cavity. A blade having a cutting edge has a retracted position in which the cutting edge is inside the cavity and a deployed position in which the cutting edge is outside of the cavity. A front operator inside the cavity engages with the blade to move the blade to the retracted position, and a rear operator inside the cavity engages with the blade to move the blade to the deployed position. A spring connected between the front operator and the rear operator provides a tension between the front and rear operators. An adjustable connection between the spring and the rear operator has a plurality of positions to adjust the tension between the front and rear operators.

In yet another embodiment of the present invention, a pocket knife includes a a chassis that defines a cavity. A blade having a cutting edge has a retracted position in which the cutting edge is inside the cavity and a deployed position in which the cutting edge is outside of the cavity. A slider inside the cavity has a rear position that moves the blade to the retracted position and a front position that moves the blade to the deployed position. A front operator is inside the cavity, and the slider engages with the front operator to move the blade to the deployed position. A rear operator is inside the cavity, and the slider engages with the rear operator to move the blade to the retracted position. A spring connected between the front operator and the rear operator provides a tension between the front and rear operators. A disc is rotatably coupled to the rear operator and releasably coupled to the spring.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
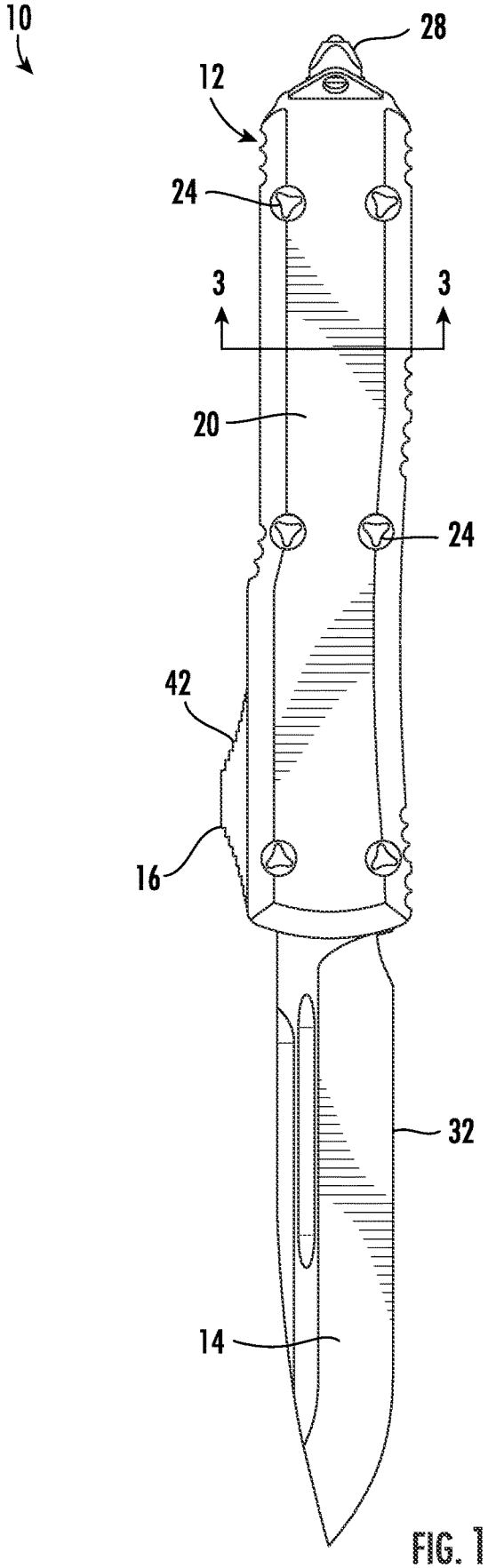
FIG. 1 is a left plan view of a pocket knife according to one embodiment of the present invention in a deployed position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a pocket knife that may be comfortably operated one-handed while accommodating manufacturing tolerances of the components. For convention of reference, the term "front" shall refer to the end of the pocket knife from which a blade deploys; the term "rear" shall refer to the end of the pocket knife that is opposite from the front; the term "top" shall refer to the side of the pocket knife that houses an actuator for operating the pocket knife; the term "bottom" shall refer to the side of the pocket knife that is opposite from the top; and the terms "left" and "right" shall refer to the opposing sides of the pocket knife that are adjacent to and generally perpendicular to the top and bottom. As used herein, the term "longitudinal" shall refer to the direction between the front and rear of the pocket knife, and the term "radial" shall refer to any direction perpendicular to the longitudinal direction.

Figure 2:
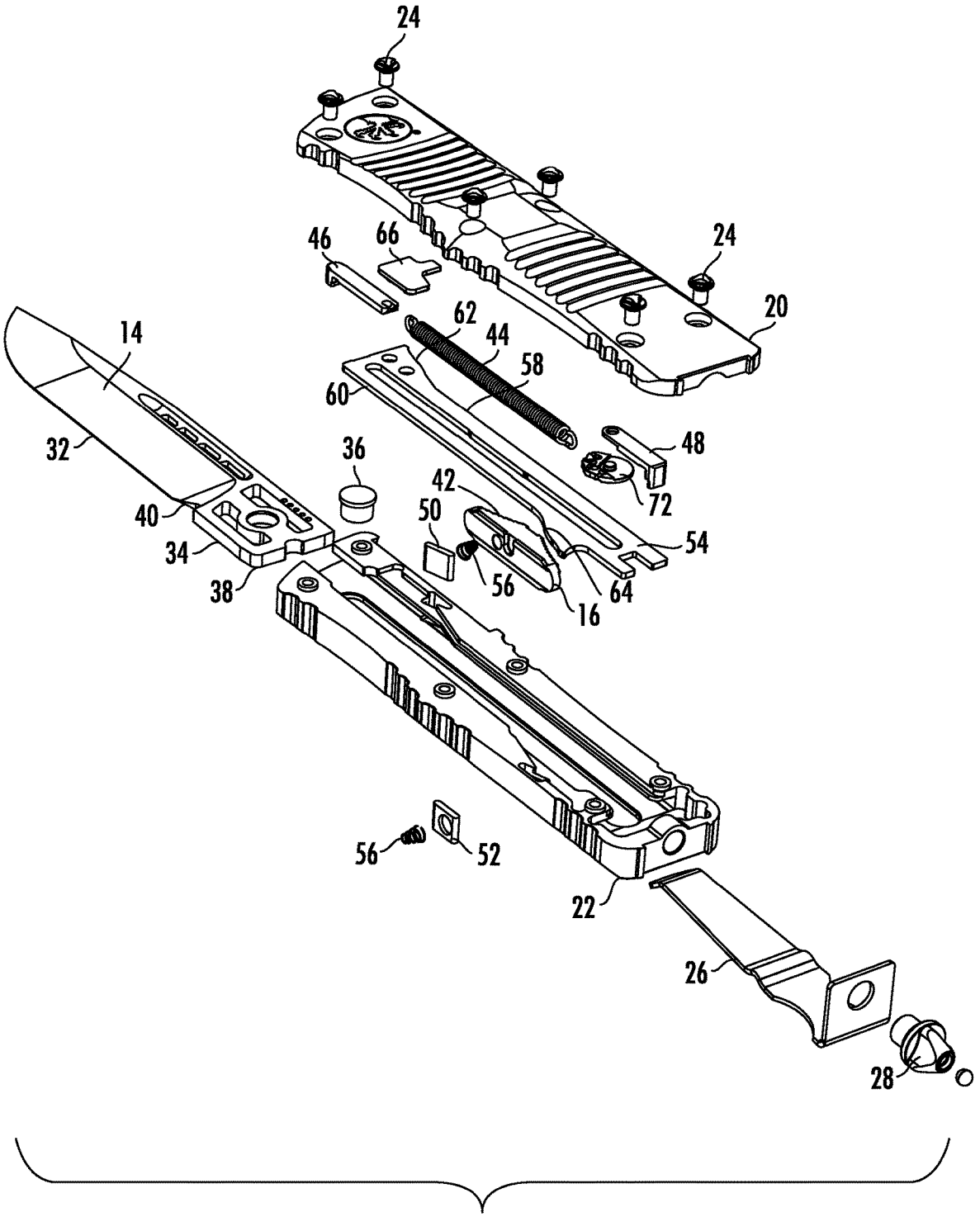
FIG. 2 an exploded view of the pocket knife shown in FIG. 1.
Figure 3:
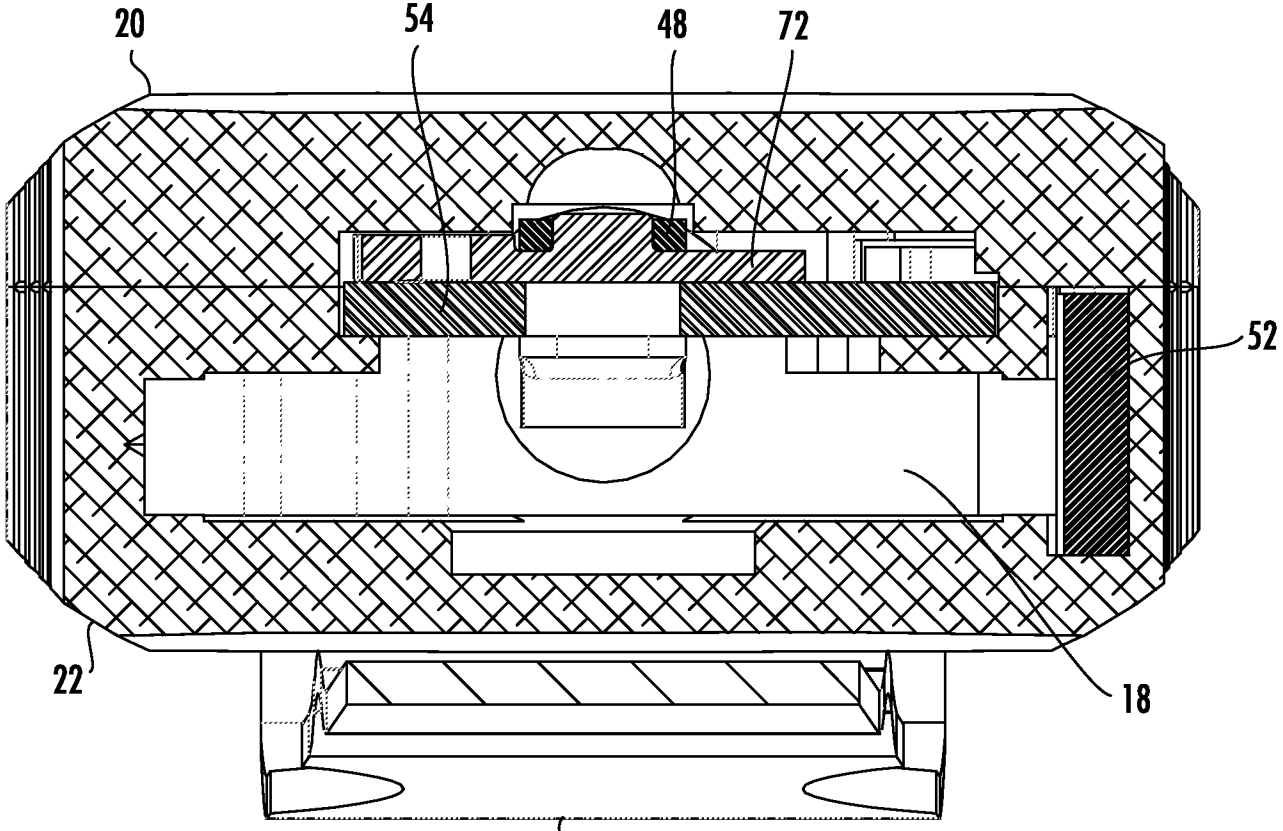
FIG. 3 is an axial cross-section view of the pocket knife shown in FIG. 1 taken along line 3-3 of FIG. 1.

FIG. 1 provides a left plan view of a pocket knife 10 according to one embodiment of the present invention in a deployed position. FIG. 2 provides an exploded view of the pocket knife 10 shown in FIG. 1, and FIG. 3 provides a cross-section view of the pocket knife 10 taken along line 3-3 of FIG. 1. As shown in FIGS. 1-3, the pocket knife 10 generally includes a chassis 12, a blade 14, and an actuator 16.

The chassis 12 defines a cavity 18 (shown in FIG. 3) and provides a frame for supporting the various components associated with the pocket knife 10. The chassis 12 may be molded, pressed, or machined from plastics, metals, polymers, or any material or combination of materials having the desired strength and durability. The chassis 12 may include a first or left scale 20 connected to a second or right scale 22 by screws 24 or other attachment means. In the particular embodiment shown in FIGS. 1-3, the screws 24 may be inserted through the left scale 20 to provide threaded engagement without passing through the right scale 22, resulting in a visually clean appearance of the right scale 22 of the chassis 12. The switchblade 10 may include an optional pocket clip 26 and glass break 28 at the rear of the chassis 12 so that the pocket clip 26 extends over the right scale 22.

Figure 6:
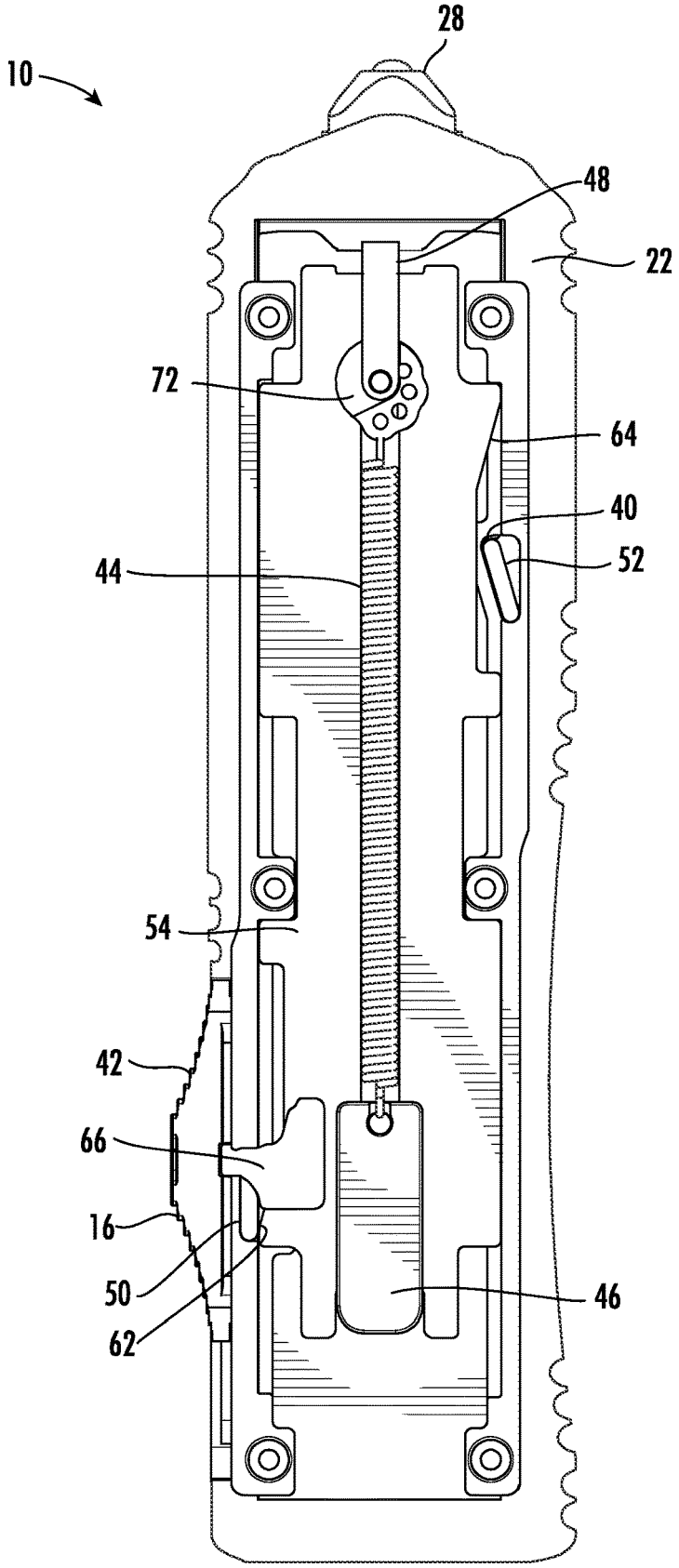
FIG. 6 is a left plan view of the pocket knife shown in FIGS. 1-3 with the left scale removed, the blade in the retracted position, the actuator in the shut position, the slider in the rear position, and the rear lock engaged with the blade.
Figure 7:
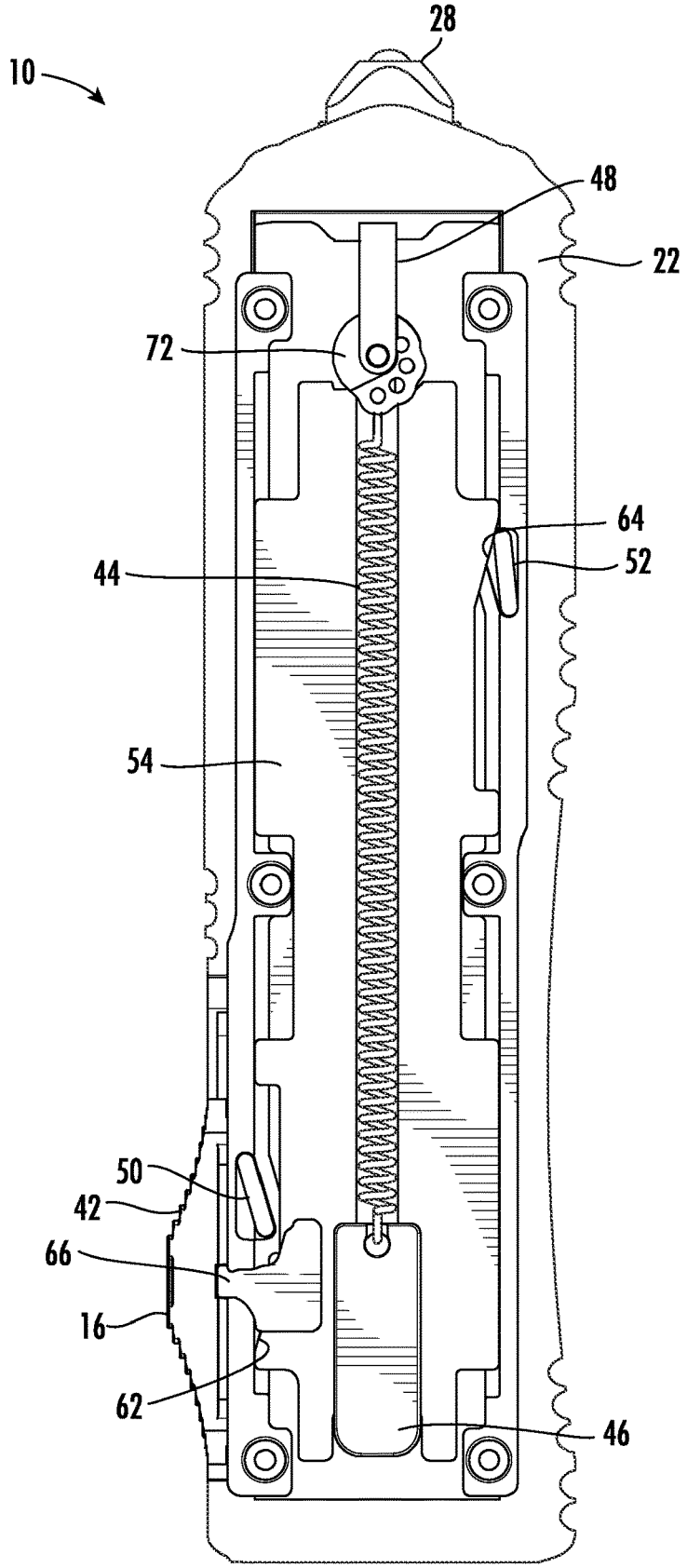
FIG. 7 is a left plan view of the pocket knife shown in FIGS. 1-3 with the left scale removed, the blade in the retracted position, the actuator in the open position, the slider in the front position, and the rear lock released from the blade.

The blade 14 generally has one or more cutting edges 32 and a tang 34, and the blade 14 can move between a deployed position and a retracted position. In the deployed position, as shown in FIGS. 1, 2, 8, and 9, the cutting edge 32 is outside of the cavity 18 of the chassis 12 to allow use of the cutting edge 32 as desired. In the retracted position, as shown in FIGS. 6 and 7, the cutting edge 32 is inside the cavity 18 of the chassis 12 to shield the cutting edge 32 from inadvertent contact that might damage the blade 14 or cause harm to personnel or objects.

As shown in FIG. 2, the tang 34 of the blade 14 may include a post 36 longitudinally separated from a rear surface 38 and a notch 40 in one or both sides. In particular embodiments, the post 36 may be simply a projection from the tang 34, while in other embodiments, as shown in FIG. 2, the post 36 may be a separate part threaded or press-fit into the tang 34. The purpose and operation of the post 36, rear surface 38, and notch 40 will be described in more detail with respect to operation of the blade 14 between the retracted and deployed positions as shown in FIGS. 6-9.

The actuator 16 controls the operation of the pocket knife 10 and is slidably engaged with the chassis 12 to reposition the blade 14 between the retracted and deployed positions. The actuator 16 and has a shut or rear position, shown in FIGS. 6 and 9, that moves the blade 14 to the retracted position and an open or front position, shown in FIGS. 1, 7, and 8, that moves the blade 14 to the deployed position. As such, the actuator 16 may include opposing sloped surfaces 42 that facilitate sliding the actuator 16 forward to deploy the blade 14 and rearward to retract the blade 14.

As shown most clearly in FIG. 2, a spring 44, front and rear operators 46, 48, front and rear locks 50, 52, and a slider 54 are located inside the cavity 18 of the chassis 12. The spring 44 is connected between the front operator 46 and the rear operator 48 to provide a tension between the front and rear operators 46, 48. As will be explained in more detail with respect to FIGS. 6-9, the front and rear operators 46, 48 alternately engage with the blade 14 and slider 54 to move the blade 14 between the retracted and deployed positions. The front and rear locks 50, 52 are pivotally connected and biased inward in the cavity 18 by springs 56. With the blade 14 in the retracted position, the rear lock 52 is in biased engagement with the notch 40 in the tang 34 to retain the blade 14 inside the chassis 12. With the blade 14 in the deployed position, the front lock 50 is in biased engagement with the rear surface 38 of the tang 34 to hold the blade 14 outside of the chassis 12.

The slider 54 has a first side 58 opposed to a second side 60, a front sloped surface 62, and a rear sloped surface 64. In the particular embodiment shown in FIG. 2, the front sloped surface 62 is located or defined on the first side 58 of the slider 54, and the rear sloped surface 64 is located or defined on the second side 60 of the slider 54. In alternate embodiments, the front and rear sloped surfaces 62, 64 may be located or defined on the same side of the slider 54, and the present invention is not limited to the specific location of the front and rear sloped surfaces 62, 64 unless specifically recited in the claims.

A tab 66 may be releasably connected to the slider 54 and engaged with the actuator 16. The releasable connection between the tab 66 and the slider 54 may be by slip fit, press fit, adhesive, or other similar methods known to one of ordinary skill in the art for releasably connecting components. The tab 66 may extend from whichever side of the slider 54 is closest to the actuator 16 so that the tab 66 engages with the actuator 16. For example, in the particular embodiment shown in FIG. 2, the tab 66 extends from the first side 58 of the slider 54. In this manner, forward or rearward movement of the actuator 16 moves the slider 54 the same direction and distance. Specifically, forward movement of the actuator 16 and slider 54 causes the rear sloped surface 64 to engage with the rear lock 52 to pivot the rear lock 52 outward, disengaging the rear lock 52 from the notch 40 in the tang 34 to allow the blade 14 to move to the deployed position. Conversely, rearward movement of the actuator 16 and slider 54 causes the front sloped surface 62 to engage with the front lock 50 to pivot the front lock 50 outward, disengaging the front lock 50 from the rear surface 38 of the tang 34 to allow the blade 14 to move to the retracted position.

Figure 4:
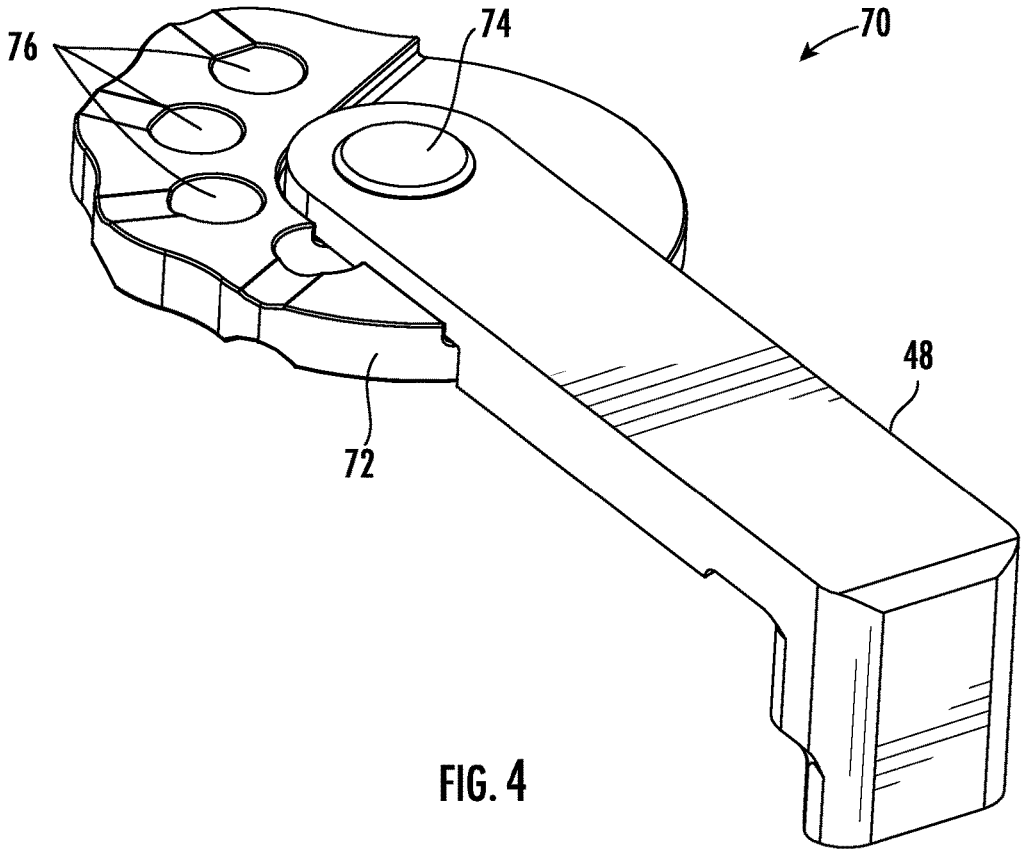
FIG. 4 is an enlarged perspective view of a means for adjusting the tension between the front and rear operators as shown in FIG. 2.

FIG. 4 provides an enlarged perspective view of a means for adjusting the tension between the front and rear operators 46, 48, as shown in FIG. 3. The function of the means is to adjust the tension—i.e., increase or decrease the tension—between the front and rear operators 46, 48. The structure for performing this function is an adjustable connection 70 between the spring 44 and the rear operator 48 that has multiple positions to adjust the tension between the front and rear operators 46, 48. As shown in FIG. 4, for example, the adjustable connection 70 may be a disc 72 having a central post 74 and a plurality of apertures 76 through the disc 72 at varying distances from the central post 74. In this embodiment, the central post 74 rotatably couples the disc 72 to the rear operator 48, and the disc 72 may be rotated to releasably couple the spring 44 to the aperture 76 that provides the desired tension between the front and rear operators 46, 48. In an alternate embodiment, the disc 72 may have a single aperture for releasably connecting to the spring 44 and multiple posts at varying distances from the aperture for coupling the disc 72 to the rear operator 48.

Figure 5:
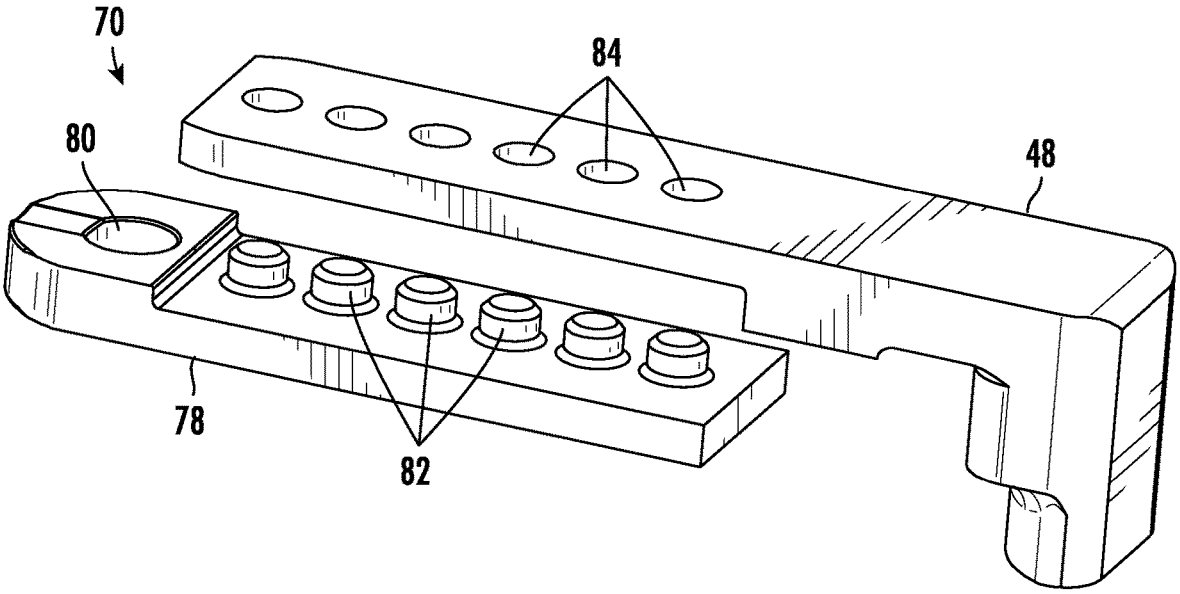
FIG. 5 is an enlarged perspective view of an alternative embodiment of the means for adjusting the tension between the front and rear operators.

FIG. 5 provides an enlarged perspective view of an alternative embodiment of the means for adjusting the tension between the front and rear operators 46, 48. As shown in FIG. 5, the adjustable connection 70 may be a joint 78 having an aperture 80 and a plurality of posts 82 that fit in one or more corresponding apertures 84 in the rear operator 48. In this embodiment, the spring 44 may releasably couple to the aperture 80 in the joint 78, and posts 82 on the joint 78 may fit in the apertures 84 in the rear operator 48 to provide the desired tension between the front and rear operators 46, 48.

Operation of the pocket knife 10 between the retracted and deployed positions will now be described with respect to FIGS. 6-9. As shown in FIG. 6, the actuator 16 is in the shut position, and the slider 54 is in the rear position with the blade 14 retracted inside the cavity 18. With the blade 14 in the retracted position, the rear operator 48 is engaged with the rear surface 38 of the tang 34, and the rear lock 52 is engaged with the notch 40 in the tang 34 to retain the blade 14 in the retracted position.

To deploy the blade 14, the actuator 16 is moved forward to the open position as shown in FIG. 7, and the engagement between the tab 66 and the actuator 16 causes the slider 54 to move forward with the actuator 16. As the slider 54 initially moves forward, the rear lock 52 remains engaged with the notch 40 in the tang 34 to prevent the blade 14 from moving, and the front of the slider 54 engages with the front operator 46 to move the front operator 46 forward and increase the tension in the spring 44 between the front and rear operators 46, 48. Eventually, the rear sloped surface 64 on the second side 60 of the slider 54 disengages the rear lock 52 from the notch 40 to release the blade 14, as shown in FIG. 7.

Figure 8:
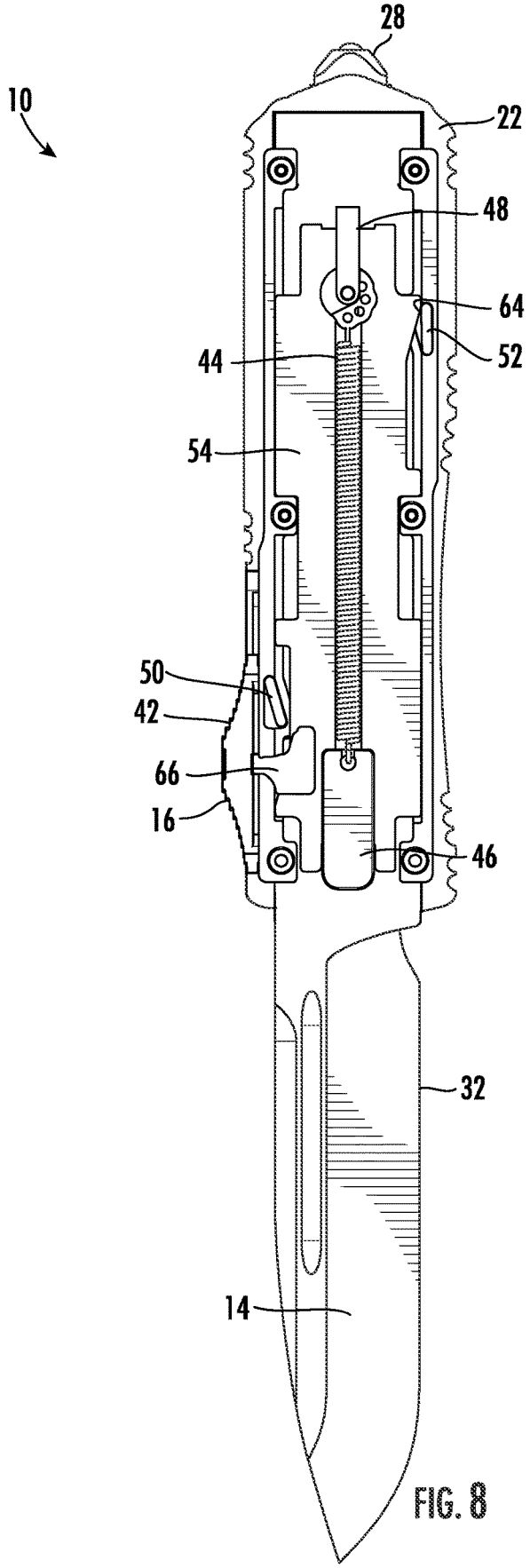
FIG. 8 is a left plan view of the pocket knife shown in FIGS. 1-3 with the left scale removed, the blade in the deployed position, the actuator in the open position, the slider in the front position, and the front lock engaged with the blade.

When the rear lock 52 disengages from the notch 40, the tension in the spring 44 causes the rear operator 48 to eject the blade 14 out of the cavity 18 to the deployed position, as shown in FIG. 8. The blade 14 moves out of the cavity 18 until the post 36 contacts the front operator 46 to prevent further travel of the blade 14 out of the cavity 18. As shown in FIG. 8, the actuator 16 is in the open position with the blade 14 deployed outside of the cavity 18. In the deployed position, the front operator 46 is engaged with the post 36, and the front lock 50 is engaged with the rear surface 38 of the tang 34 to hold the blade 14 in the deployed position.

Figure 9:
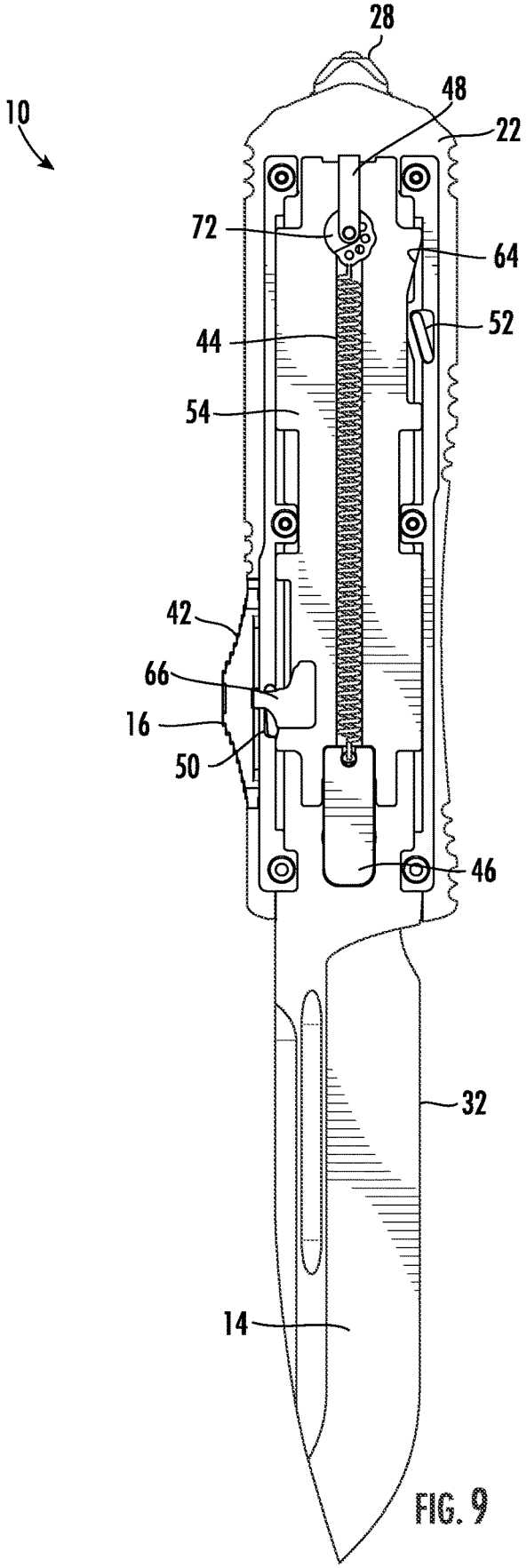
FIG. 9 is a left plan view of the pocket knife shown in FIGS. 1-3 with the left scale removed, the blade in the deployed position, the actuator in the shut position, the slider in the rear position, and the front lock released from the blade.

To retract the blade 14, the actuator 16 is moved rearward to the shut position as shown in FIG. 9, and the engagement between the tab 66 and the actuator 16 causes the slider 54 to move rearward with the actuator 16. As the slider 54 initially moves rearward, the front lock 50 remains engaged with the rear surface 38 of the tang 34 to prevent the blade 14 from moving, and the rear of the slider 54 engages with the rear operator 48 to move the rear operator 48 rearward and increase the tension in the spring 44 between the front and rear operators 46, 48. Eventually, the front sloped surface 62 on the first side 58 of the slider 54 disengages the front lock 50 from the rear surface 38 of the tang 34 to release the blade 14, as shown in FIG. 9.

When the front lock 50 disengages from the rear surface 38 of the tang 34, the tension in the spring 44 causes the front operator 46 to pull the blade 14 into the cavity 18 to the retracted position, as shown in FIG. 6. The blade 14 moves into the cavity 18 until the rear surface 38 of the tang 34 contacts the rear operator 48, and the rear lock 52 again engages with the notch 40 in the tang 34 to retain the blade 14 in the retracted position.

The various embodiments of the present invention thus allow the tension in the spring 44 between the front and rear operators 46, 48 to be adjusted to accommodate blades 14 of different weight and/or manufacturing tolerances in the length and/or elasticity of the spring 44. As a result, the force required to operate the pocket knife 10 may be adjusted to enhance the convenient and reliable operation of the pocket knife 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A pocket knife, comprising:

a chassis, wherein said chassis defines a cavity;

a blade having a cutting edge, wherein said blade has a retracted position in which said cutting edge is inside said cavity and a deployed position in which said cutting edge is outside of said cavity;

a slider inside said cavity, wherein said slider has a rear position that moves said blade to said retracted position and a front position that moves said blade to said deployed position;

a front operator inside said cavity, wherein said slider engages with said front operator to move said blade to said deployed position;

a rear operator inside said cavity, wherein said slider engages with said rear operator to move said blade to said retracted position;

a spring connected between said front operator and said rear operator, wherein said spring provides a tension between said front and rear operators; and a means for adjusting said tension between said front and rear operators.

2. The pocket knife as in claim 1, wherein said means for adjusting said tension between said front and rear operators comprises a disc rotatably coupled to said rear operator, and said disc releasably couples said spring to said rear operator.

3. The pocket knife as in claim 1, wherein said means for adjusting said tension between said front and rear operators comprises a plurality of apertures through said rear operator.

4. The pocket knife as in claim 1, wherein said slider inside said cavity engages with said front operator to move said blade to said deployed position.

5. The pocket knife as in claim 1, wherein said slider inside said cavity engages with said rear operator to move said blade to said retracted position.

6. The pocket knife as in claim 1, further comprising a front lock inside said cavity and engaged with said blade in said deployed position.

7. The pocket knife as in claim 1, further comprising a rear lock inside said cavity and engaged with said blade in said retracted position.

8. A pocket knife, comprising:

a chassis, wherein said chassis defines a cavity;

a blade having a cutting edge, wherein said blade has a retracted position in which said cutting edge is inside said cavity and a deployed position in which said cutting edge is outside of said cavity;

a front operator inside said cavity that engages with said blade to move said blade to said retracted position;

a rear operator inside said cavity that engages with said blade to move said blade to said deployed position;

a spring connected between said front operator and said rear operator, wherein said spring provides a tension between said front and rear operators; and an adjustable connection between said spring and said rear operator, wherein said adjustable connection has a plurality of positions to adjust said tension between said front and rear operators.

9. The pocket knife as in claim 8, further comprising a plurality of apertures through said adjustable connector.

10. The pocket knife as in claim 8, further comprising a plurality of apertures through said rear operator.

11. The pocket knife as in claim 8, further comprising a slider inside said cavity that engages with said front operator to move said blade to said deployed position.

12. The pocket knife as in claim 8, further comprising a slider inside said cavity that engages with said rear operator to move said blade to said retracted position.

13. The pocket knife as in claim 8, further comprising a front lock inside said cavity and engaged with said blade in said deployed position.

14. The pocket knife as in claim 8, further comprising a rear lock inside said cavity and engaged with said blade in said retracted position.

15. A pocket knife, comprising:

a chassis, wherein said chassis defines a cavity;

a blade having a cutting edge, wherein said blade has a retracted position in which said cutting edge is inside said cavity and a deployed position in which said cutting edge is outside of said cavity;

a slider inside said cavity, wherein said slider has a rear position that moves said blade to said retracted position and a front position that moves said blade to said deployed position;

a front operator inside said cavity, wherein said slider engages with said front operator to move said blade to said deployed position;

a rear operator inside said cavity, wherein said slider engages with said rear operator to move said blade to said retracted position;

a spring connected between said front operator and said rear operator, wherein said spring provides a tension between said front and rear operators; and a disc rotatably coupled to said rear operator and releasably coupled to said spring.

16. The pocket knife as in claim 15, further comprising a plurality of apertures through said disc.

17. The pocket knife as in claim 15, wherein said slider inside said cavity engages with said front operator to move said blade to said deployed position.

18. The pocket knife as in claim 15, wherein said slider inside said cavity engages with said rear operator to move said blade to said retracted position.

19. The pocket knife as in claim 15, further comprising a front lock inside said cavity and engaged with said blade in said deployed position.

20. The pocket knife as in claim 15, further comprising a rear lock inside said cavity and engaged with said blade in said retracted position.

* * * * *